US009033050B2

(12) United States Patent
Long

(10) Patent No.: US 9,033,050 B2
(45) Date of Patent: May 19, 2015

(54) ROV DRIVE BUCKET PLUG

(76) Inventor: Nicholas Long, Swansea (GB)

( * ) Notice: Subject to any disclaimer, the term of this patent is extended or adjusted under 35 U.S.C. 154(b) by 564 days.

(21) Appl. No.: 13/358,112

(22) Filed: Jan. 25, 2012

(65) Prior Publication Data

US 2012/0186039 A1 Jul. 26, 2012

(51) Int. Cl.
*E21B 7/12* (2006.01)
*E21B 41/04* (2006.01)

(52) U.S. Cl.
CPC ..... *E21B 41/04* (2013.01)

(58) Field of Classification Search
CPC ..... E21B 43/00
USPC ..... 166/338, 341, 351, 386; 405/190, 191; 251/89, 90; 464/160
See application file for complete search history.

(56) References Cited

U.S. PATENT DOCUMENTS

| | | | | |
|---|---|---|---|---|
| 3,959,987 | A * | 6/1976 | Garey | 464/155 |
| 4,415,102 | A * | 11/1983 | Teske | 222/411 |
| 5,002,129 | A * | 3/1991 | Hopper | 166/338 |
| 5,048,914 | A * | 9/1991 | Sneddon | 385/53 |
| 5,194,012 | A * | 3/1993 | Cairns | 439/201 |
| 6,041,804 | A * | 3/2000 | Chatufale | 137/15.23 |
| 6,098,715 | A * | 8/2000 | Seixas et al. | 166/347 |
| 6,109,352 | A * | 8/2000 | Edwards et al. | 166/336 |
| 6,188,327 | B1 * | 2/2001 | Cousins et al. | 340/853.9 |
| 6,231,027 | B1 * | 5/2001 | Baker et al. | 251/58 |
| 6,503,021 | B2 * | 1/2003 | Corbetta | 405/170 |
| 6,585,227 | B2 * | 7/2003 | Newport et al. | 251/58 |
| 6,609,532 | B1 * | 8/2003 | Peterson | 137/15.18 |
| 6,609,533 | B2 * | 8/2003 | Sundararajan | 137/15.19 |
| 6,659,133 | B2 * | 12/2003 | Russell | 138/94 |
| 6,682,105 | B2 * | 1/2004 | Latham et al. | 285/261 |
| 7,090,019 | B2 * | 8/2006 | Barrow et al. | 166/361 |
| 7,398,764 | B2 * | 7/2008 | Koehler et al. | 123/458 |
| 7,556,239 | B2 * | 7/2009 | Beebe | 251/248 |
| 7,770,649 | B2 * | 8/2010 | Biester et al. | 166/338 |
| 8,011,434 | B2 * | 9/2011 | Cosgrove et al. | 166/341 |
| 8,020,623 | B2 * | 9/2011 | Parks et al. | 166/341 |
| 8,261,818 | B2 * | 9/2012 | Pallini et al. | 166/206 |
| 8,550,167 | B2 * | 10/2013 | Comeaux et al. | 166/338 |
| 8,662,181 | B2 * | 3/2014 | Hamblin et al. | 166/338 |
| 8,720,587 | B2 * | 5/2014 | Edwards | 166/373 |
| 2001/0051452 | A1 * | 12/2001 | Walker | 439/248 |
| 2005/0081916 | A1 * | 4/2005 | Williams et al. | 137/315.11 |
| 2005/0252556 | A1 * | 11/2005 | Williams et al. | 137/596.17 |
| 2007/0209724 | A1 * | 9/2007 | Williams et al. | 137/625.65 |
| 2011/0241336 | A1 * | 10/2011 | Long | 285/322 |
| 2012/0181786 | A1 * | 7/2012 | Morris | 285/131.1 |
| 2012/0234410 | A1 * | 9/2012 | Borchgrevink et al. | 137/556 |
| 2013/0192842 | A1 * | 8/2013 | Overstreet et al. | 166/340 |
| 2013/0220206 | A1 * | 8/2013 | Mogedal et al. | 114/296 |
| 2013/0248037 | A1 * | 9/2013 | Burton et al. | 138/89 |
| 2014/0068883 | A1 * | 3/2014 | Long | 15/104.062 |

* cited by examiner

*Primary Examiner* — Matthew Buck
*Assistant Examiner* — Aaron Lembo

(57) ABSTRACT

A plug plugs into a ROV drive bucket limiting rotation of a drive shaft therein to say 15° and reducing the build-up of marine growth in the bucket. As shown it includes a polyethylene body (which may be made in two parts 12, 13) housing a metal socket 11 mounted for limited angular orientation therein. The socket has a twenty four point aperture or recess (22) which fits over a squared end of a drive shaft 10 at various angles orientation. The socket has external splines (20) which fit loosely in wide internal grooves (21) in the body and self-orientates within the body when the body is plugged into the bucket. The plug has a pair of diametrically opposite dogs (4) which engage in slots (5), included in flanges on conventional buckets.

9 Claims, 3 Drawing Sheets

ROV DRIVE BUCKET PLUG

ROV drive buckets (also known as torque buckets) are in common use in the subsea oil and gas industry. Drive buckets for subsea remotely operated vehicle (ROV) torque tool docking frequently conform to American Petroleum Institute standard 17D or to ISO standard 13628. Such a bucket comprises a torque receptacle into which a ROV torque tool can dock. In use the bucket is secured to a casing part of a mechanism such as a subsea connector or valve to be actuated (e.g. opened and/or closed). The bucket is mounted around a drive shaft of the mechanism and provides a slot and dog torque reaction to the ROV, when a torque is applied by the ROV to the drive shaft. The drive shaft has a multifaceted end which is usually a squared end.

A device which plugs into a ROV drive bucket mounted around a drive shaft and fits over the drive shaft limiting or preventing the drive shall from turning while not engaged by a ROV is known.

The object of the present invention is to provide a ROV drive bucket plug which self adapts to the angular orientation of a drive shaft relative to the drive bucket when plugged into the drive bucket.

The present invention provides a drive bucket plug comprising a body which plugs into a ROV drive bucket in a manner which prevents or limits angular rotation of the body relative to the drive bucket, and a socket adapted to fit over a multifaceted end of a drive shaft; said socket being mounted for limited angular orientation within said body.

Preferably said socket has a tapered entry zone which causes said socket to be orientated within said body upon initial engagement with the drive shaft.

Said body may include at least one dog tapered to orientate the body relative to the drive bucket.

Preferably said socket has a multipoint aperture or recess that can fit over said multifaceted end at a number of angles, said number being a multiple of the number of facets of said multifaceted end.

Preferably said socket has a twenty four point aperture or recess shaped to fit over a squared end of a stationary drive shaft every 15° of its orientation.

The invention will now be described solely by way of example and with reference to the accompanying drawings in which.

Figure 1:
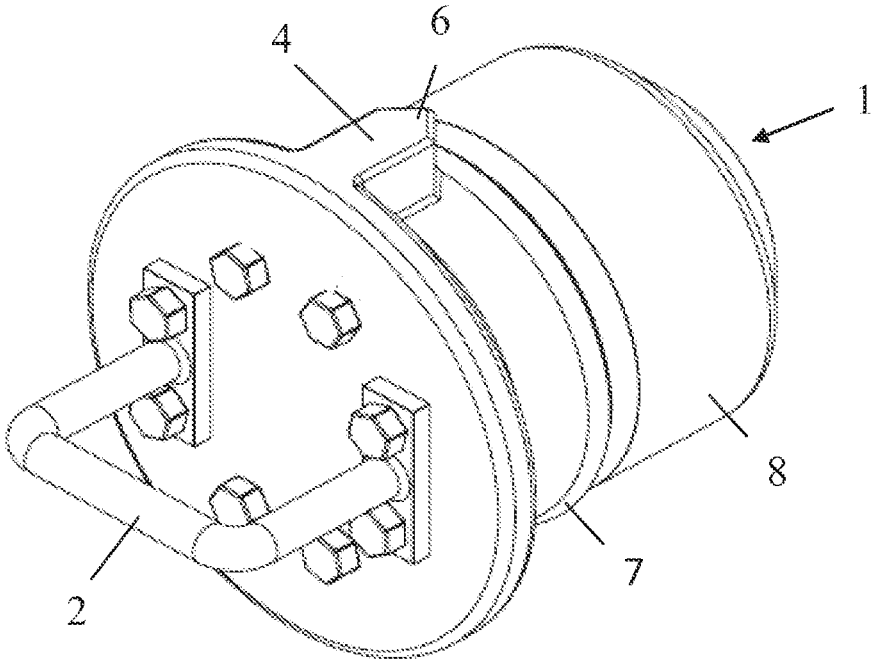
FIG. 1 shows a rear isometric of a ROV drive bucket plug.

Initially referring to FIGS. 1 and 2, a ROV drive bucket plug 1 has a grab handle 2 enabling it to be engaged by a subsea Remotely Operated Vehicle (subsequently referred to as a ROV). In use the ROV inserts the plug 1 into a ROV drive bucket 3 as shown in FIG. 2. The drive bucket may conform to API standard 17D or to ISO standard 13628. These buckets are designed for coupling to a standard subsea intervention torque tool of an ROV to permit actuation of an adjustment mechanism by rotation of a shaft which conventional has a squared end. The plug has a pair of diametrically opposite dogs 4 which engage in slots 5, conventionally included in flanges on these buckets. Each dog has a front end 6 tapered to orientate the plug body relative to the drive bucket during insertion into the drive bucket.

Figure 2:
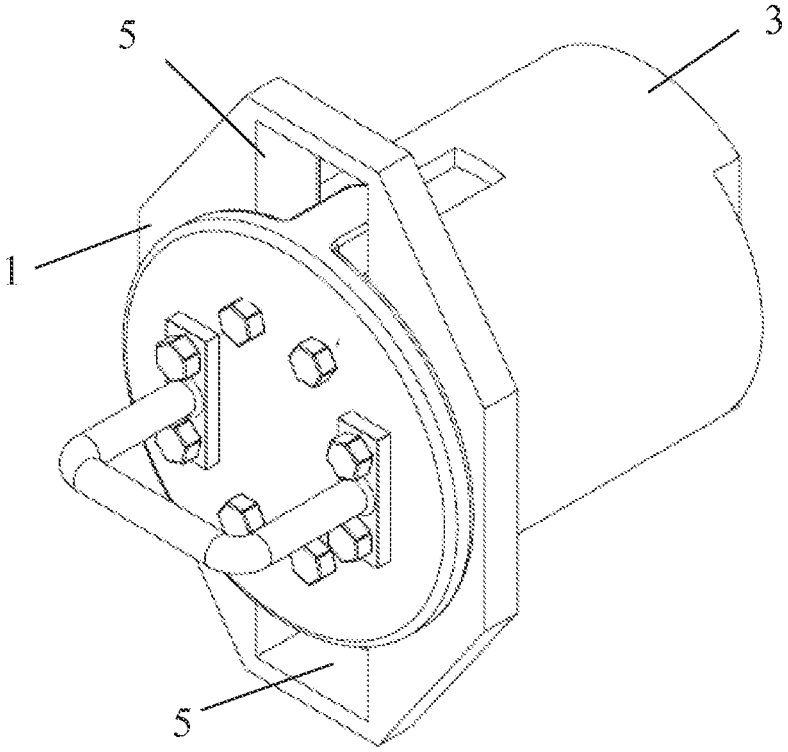
FIG. 2 shows an isometric of the plug when plugged into a ROV drive bucket.
Figure 3:
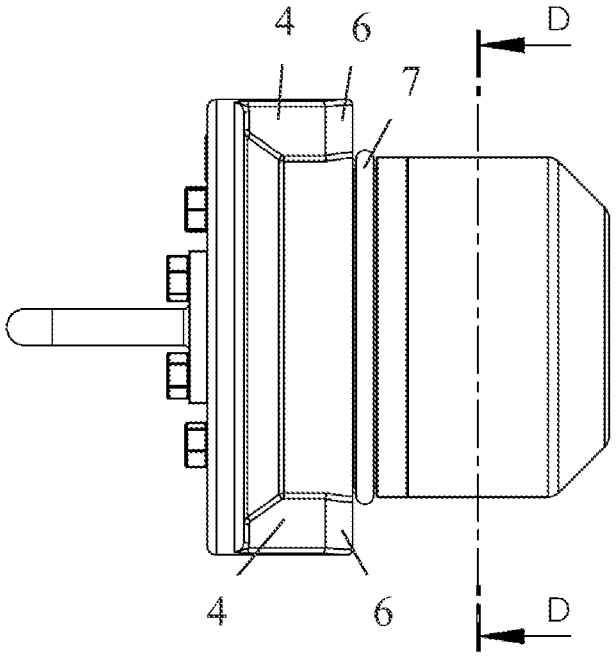
FIG. 3 shows a side view of the plug.

As shown in FIGS. 1 and 3, an O'ring 7 fits in an annular groove round a plug body 8 and provides a tight fit between the plug and the drive bucket. The plug is thus held in the drive bucket by friction between the O'ring and the bucket. Resilient clips could alternative or additionally provided for this purpose. The dogs 4 are thus held in the slots 5 and prevent or limit angular rotation of the body relative to the drive bucket.

Figure 4:
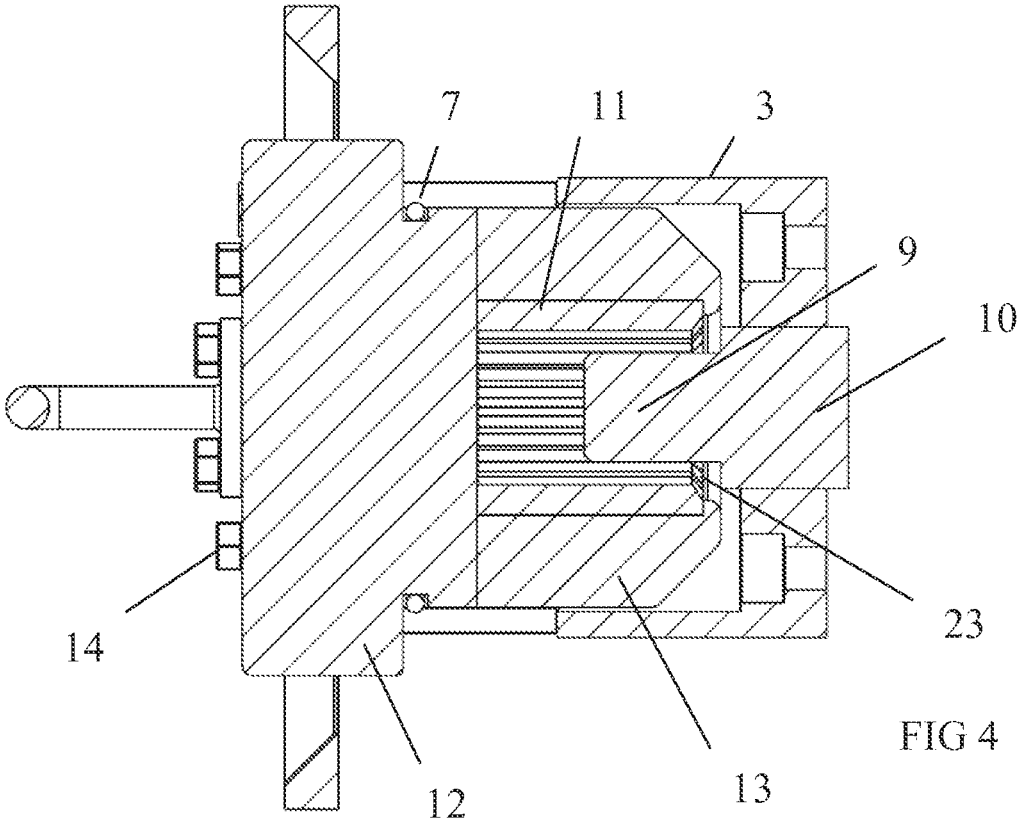
FIG. 4 shows a side cross-sectional view through a plug and bucket assembly.
Figure 5:
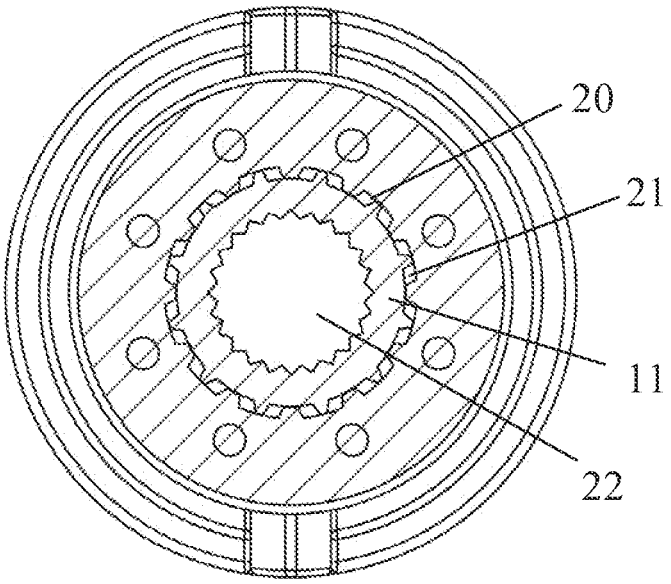
FIG. 5 shows a front cross-sectional view taken along line D-D in FIG. 3.
Figure 6:
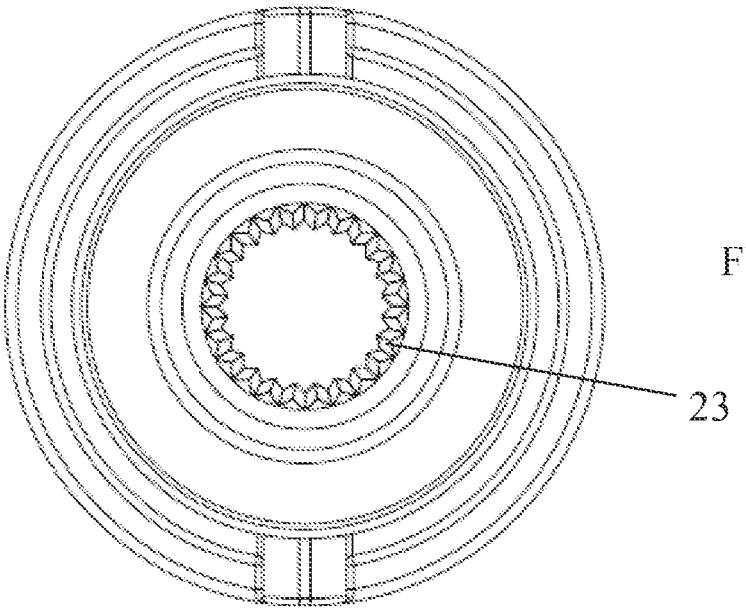
FIG. 6 shows a front end view of the plug.

FIG. 4 shows a side cross-sectional view through a plug and bucket assembly in use with the bucket 3 mounted around a squared (or otherwise multifaceted) end 9 of a shaft 10 to be driven. A metal socket 11 adapted to fit over the end of a drive shaft is mounted for limited free angular orientation within the body 8. The socket 11 has external splines 20 which locate in internal grooves 21 in said body, said grooves having sufficient width in a circumferential direction to allow limited angular orientation of the socket within said body, by say 15°. As shown the socket has a twenty four point aperture or recess 22. It is shaped to fit (every 15° of its orientation) over a squared end of a stationary drive shaft. FIG. 6 shows that the socket has a tapered entry zone 23 (see also FIG. 4) which causes said socket to be orientated within said body upon initial engagement with the drive shaft. If the splines 20 are initially centrally located circumferentially within their grooves the socket would turn by up to 7.5° if necessary to match to the orientation of the shaft.

When our ROV drive bucket plug is plugged into a drive bucket, the socket will turn, if necessary, within its angular orientation limits so as to self adapt our plug to the angular orientation of a drive shaft relative to the drive bucket without any rotation of the shaft.

The body may be made from Ultra High Molecular Weight Polyethylene but could also be made of metal if a high torque capacity is required. The body is preferably manufactured in two parts held together by bolts 14.

Preferably the body closely conforms to the interior of the drive bucket. This reduces the build up of marine growth in a drive bucket.

The invention claimed is:

1. A drive bucket plug comprising a body which plugs into a ROV drive bucket mounted around a drive shaft having a multifaceted end in a manner which prevents or limits angular rotation of the body relative to the drive bucket, and a socket adapted to fit over said drive shaft; said socket being mounted in captive manner within said body so as to allow limited free angular orientation of said socket within said body.

2. A drive bucket plug as claimed in claim 1, said socket having a tapered entry zone which causes said socket to be orientated within said body upon initial engagement with the drive shaft.

3. A drive bucket plug as claimed in claim 1, said body including at least one dog tapered to orientate the body relative to the drive bucket.

4. A drive bucket plug as claimed in claim 1, said socket having a multipoint aperture or recess that can fit over said multifaceted end at a number of angles, said number being a multiple of the number of facets of said multifaceted end.

5. A drive bucket plug as claimed in claim 4, said socket having a twenty four point aperture or recess shaped to fit over a squared end of a stationary drive shaft every 15° of its orientation.

6. A drive bucket plug as claimed in claim 1, said body including an annular groove round a plug body, said groove being adapted to receive an O-ring.

7. A drive bucket plug as claimed in claim 1, said socket having external splines which locate in internal grooves in said body, said grooves having sufficient width in a circumferential direction to allow limited angular orientation of said socket within said body.

8. A drive bucket plug as claimed in claim 1, said body being made from polyethylene.

9. A drive bucket plug as claimed in claim 8, said body being manufactured in two parts.

* * * * *